US010197355B2

(12) United States Patent
Lamboy

(10) Patent No.: US 10,197,355 B2
(45) **Date of Patent: *Feb. 5, 2019**

(54) COCKING AND LOADING APPARATUS FOR REPEATER AIR RIFLE

(71) Applicant: Stephen R. Lamboy, Fort Smith, AR (US)

(72) Inventor: Stephen R. Lamboy, Fort Smith, AR (US)

(73) Assignee: Umarex USA, Inc., Fort Smith, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/825,560

(22) Filed: Nov. 29, 2017

(65) Prior Publication Data

US 2018/0149445 A1 May 31, 2018

Related U.S. Application Data

(60) Provisional application No. 62/428,477, filed on Nov. 30, 2016.

(51) Int. Cl.

| | |
|---|---|
| ***F41B 11/642*** | (2013.01) |
| ***F41B 11/54*** | (2013.01) |
| ***F41B 11/50*** | (2013.01) |
| ***F41B 11/683*** | (2013.01) |

(52) U.S. Cl.
CPC ..... *F41B 11/683* (2013.01); *F41B 11/54* (2013.01); *F41B 11/642* (2013.01)

(58) Field of Classification Search
CPC ..... F41B 11/64; F41B 11/642; F41B 11/646; F41B 11/647; F41B 11/50; F41B 11/54; F41B 11/60; F41B 11/68; F41B 11/683; F41B 11/681; F41B 11/723; F41B 11/73; F41B 7/003; F41B 7/006; F41B 7/08; F41B 7/00
USPC ..... 124/60, 63, 64, 65, 67
See application file for complete search history.

(56) References Cited

U.S. PATENT DOCUMENTS

| | | | | | |
|---|---|---|---|---|---|
| 507,470 | A * | 10/1893 | Bailey | F41B 11/647 | 124/49 |
| 1,259,463 | A * | 3/1918 | De Fir | F41B 11/647 | 124/37 |
| 1,323,640 | A * | 12/1919 | Lefever | F41B 11/647 | 124/52 |
| 1,390,569 | A * | 9/1921 | Lefever | F41B 11/647 | 124/67 |
| 2,856,716 | A * | 10/1958 | Compton | F41A 9/25 | 42/15 |
| 3,245,392 | A * | 4/1966 | Daniel | F41B 11/51 | 124/27 |
| 3,503,299 | A * | 3/1970 | Billingslea | F41A 17/46 | 124/67 |
| 3,741,189 | A * | 6/1973 | Kester | F41B 11/54 | 124/48 |
| 3,782,359 | A * | 1/1974 | Kester | F41A 9/85 | 124/48 |

(Continued)

*Primary Examiner* — Derrick R Morgan
(74) *Attorney, Agent, or Firm* — Eric B. Fugett; Mark A. Pitchford; Pitchford Fugett, PLLC

(57) ABSTRACT

A cocking and loading system for an air rifle utilizes a movable compression cylinder linked to the cocking arm to urge a piston into a cocked position, wherein the compression cylinder returns to a rest position urging a pellet feed tube through a magazine to load a pellet into the barrel.

20 Claims, 10 Drawing Sheets

(56) References Cited

U.S. PATENT DOCUMENTS 3,818,887 A * 6/1974 Akiyama ..... F41A 17/38 124/53
3,908,626 A * 9/1975 Hammond ..... F41B 11/648 124/40
3,913,553 A * 10/1975 Braughler ..... F41B 11/54 124/44.7
3,924,599 A * 12/1975 Hammond ..... F41A 17/48 124/40
4,282,852 A * 8/1981 Omana ..... F41B 11/683 124/67
4,732,136 A * 3/1988 Ferri ..... F41B 11/646 124/67
4,843,751 A * 7/1989 Ferri ..... F41B 11/55 124/67
4,850,328 A * 7/1989 Sindel ..... F41A 9/41 124/41.1
4,986,251 A * 1/1991 Lilley ..... F41B 11/54 124/48
5,150,701 A * 9/1992 Wackrow ..... F41B 11/54 124/48
5,193,517 A * 3/1993 Taylor ..... F41B 11/64 124/65
5,261,384 A * 11/1993 Hu ..... F41B 11/57 124/16
6,470,871 B2 * 10/2002 Casas-Salva ..... F41B 11/54 124/48
8,132,563 B2 * 3/2012 Gore ..... F41B 11/648 124/65
8,671,928 B2 * 3/2014 Hague ..... F41B 11/71 124/73
9,389,042 B1 * 7/2016 Clayton ..... F41B 11/642
2002/0059925 A1 * 5/2002 Casas Salva ..... F41B 11/54 124/28
2003/0075160 A1 * 4/2003 Petrosyan ..... F41B 11/55 124/45
2007/0289586 A1 * 12/2007 Tsurumoto ..... F41B 11/55 124/73
2010/0022160 A1 * 1/2010 Lee ..... F41B 11/646 446/473
2010/0065032 A1 * 3/2010 Yang ..... F41B 11/57 124/27
2015/0059724 A1 * 3/2015 Yang ..... F41B 11/646 124/66
2015/0354918 A1 * 12/2015 Gore ..... F41B 11/642 124/66
2017/0089664 A1 * 3/2017 Kras ..... F41B 11/648
2018/0045484 A1 * 2/2018 Zhu ..... F41B 11/681
2018/0058801 A1 * 3/2018 Gore ..... F41B 11/64

* cited by examiner

COCKING AND LOADING APPARATUS FOR REPEATER AIR RIFLE

This application claims priority from U.S. Provisional Patent application No. 62/428,477, filed on Nov. 30, 2016, which is incorporated by reference in its entirety.

FIELD OF INVENTION

This invention relates to air rifles and more particularly to the charging system for an air rifle. In greater particularity the present invention relates to the combination of the charging mechanism with a magazine for a repeating air rifle.

BACKGROUND

Modern technology has utilized cocking mechanisms for air rifles wherein a lever mounted to the rifle moves a piston against a spring such that a volume of air is drawn into an associated cylinder and rapidly released by the spring forcing a piston within the cylinder to return. The nature of the spring is variable and maybe a coil spring, a gas spring, an air strut, or any other variation used to bias the piston in position to compress the volume of air necessary to fire the projectile. Depending on the type projectile fired by the air rifle, the projectile may be introduced one at a time into the breach of an air rifle that opens to receive the projectile while compressing the spring or by a feeder magazine.

BRIEF DESCRIPTION OF THE DRAWINGS

Referring to the drawings which are appended hereto and which form a portion of this disclosure, it may be seen that.

DETAILED DESCRIPTION

Figure 1:
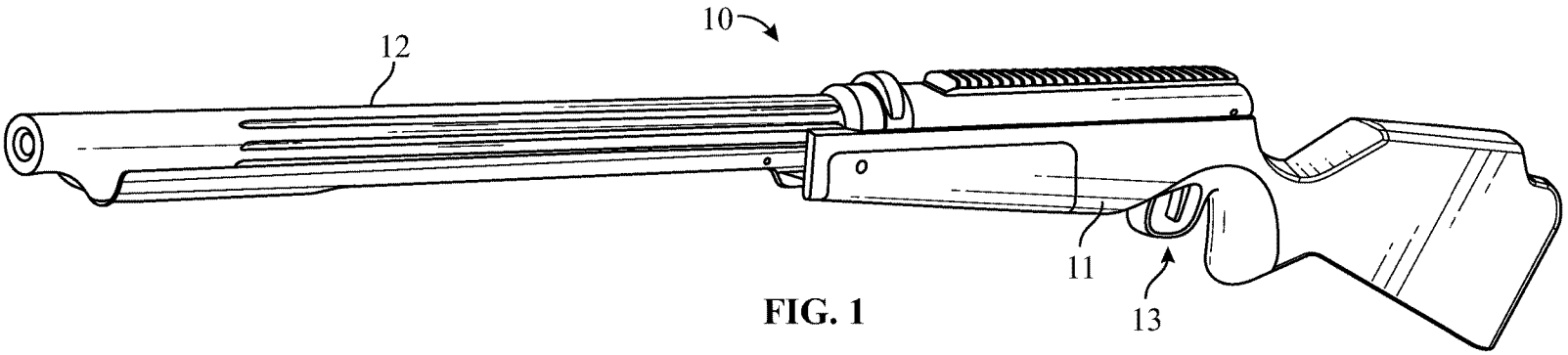
FIG. 1 is a perspective view of the rifle.

The current improvement utilizes a novel construction to enable inline feeding and firing of a pellet from a rotary magazine to the barrel of a rifle. Referring to the drawings it may be seen that the rifle uses an under barrel cocking lever to charge an internal cylinder with the air needed to expel a pellet through the barrel.

Figure 2:
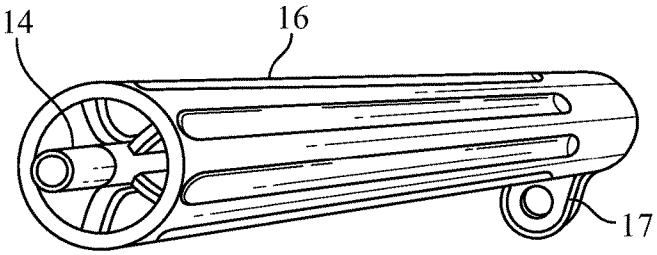
FIG. 2 is a perspective view of the sheathed barrel.
Figure 3:
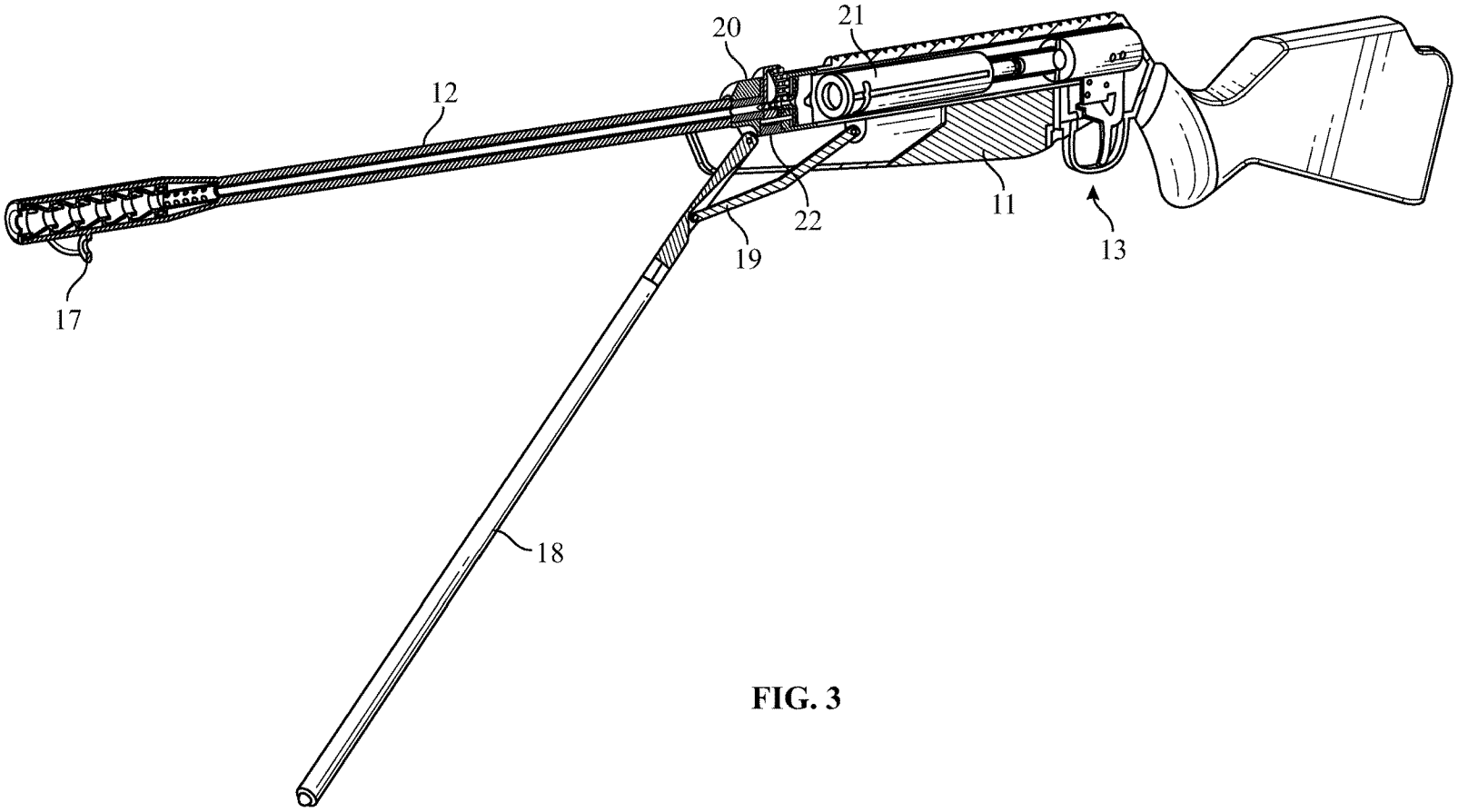
FIG. 3 is a sectional perspective view of the rifle.
Figure 4:
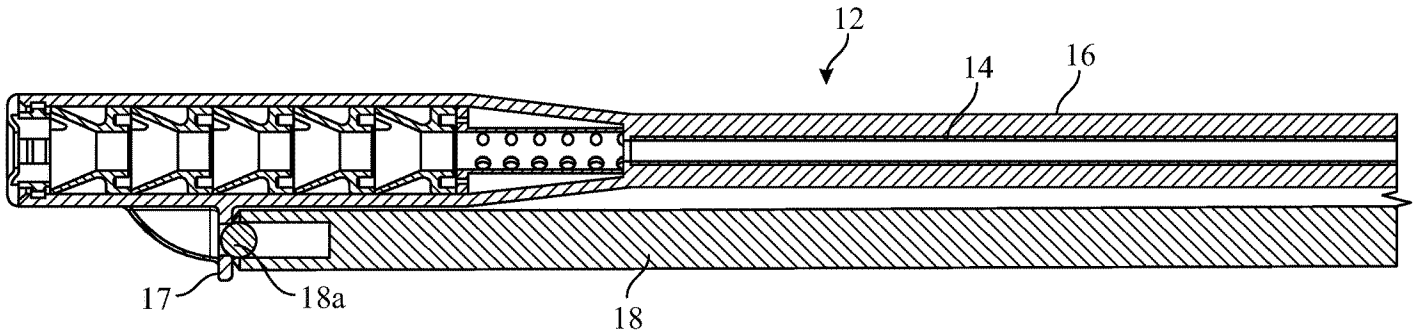
FIG. 4 is a side elevation view of the barrel end and cocking lever retention ball.

Referring to FIGS. 1 and 3 the air rifle 10 has the traditional components of a stock 11, barrel 12, and trigger assembly 13. In many regards, the trigger assembly works the same as a traditional trigger assembly. FIG. 2 illustrates the metal barrel 14 surrounded by the sheathed over-molding 16, although the barrel may also be shrouded, and also shows the depending detent flange 17.

Referring to FIG. 3, note that the underlever cocking arm 18 is hingedly connected to a cylinder housing 20 within the stock 11 and carries a press fit ball plunger that mates with detent flange 17 to hold the cocking arm in place when not in use to cock the air rifle. A linkage bar 19 connects to the under rifle lever cocking arm 18 to a deep drawn steel cylinder 21 slidably mounted within cylinder housing 20. A downwardly opening slot in stock 11 allows the linkage bar 19 to connect to cylinder 21 for movement of the cylinder. Barrel assembly 12 is threaded or bonded to the cylinder housing Referring to FIGS. 3 and 5, note that a magazine adapter 22 is positioned adjacent the barrel within the cylinder housing 20. The adaptor 22 is designed to receive a spring loaded rotary magazine 23, shown in FIG. 13, that will rotate each of a plurality of magazine chambers into alignment with the barrel 12. More specifically, the adaptor 22 includes a forward tube 24 aligned with barrel 12 and a rear tube 25 extending along the same axis as forward tube 24. Intermediate the forward and rear tubes adaptor 22 includes a body into which the rotary magazine 23 is received. Forward tube 24 forms a part of and is welded the portion of the cylinder housing 20 to which cocking arm 18 is hingedly attached. Rear tube 25 and the body are welded the rear portion of the cylinder housing 20 within which the remainder of the cocking mechanism is retained.

Figure 5:
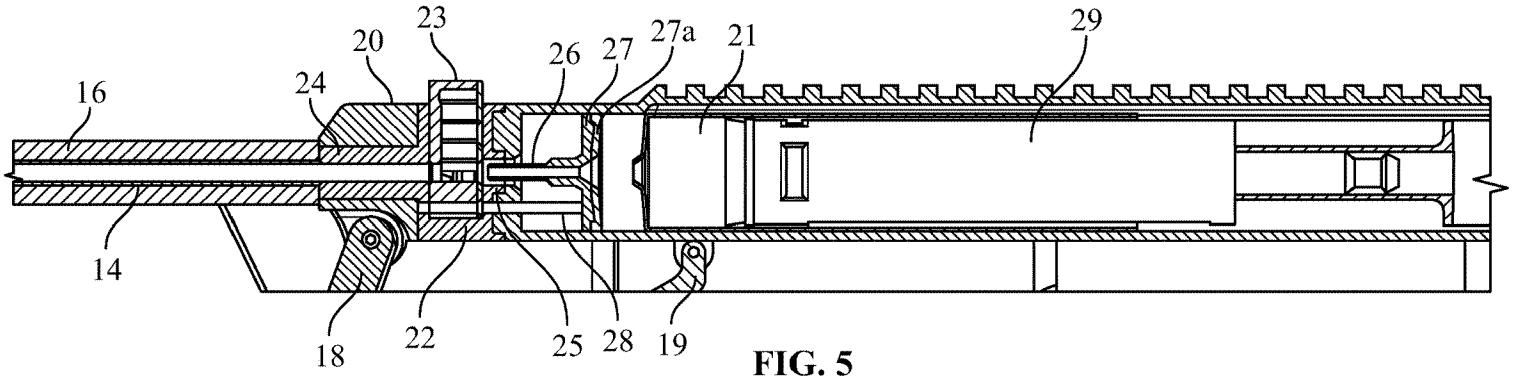
FIG. 5 is a partial sectional view showing a first embodiment of charging chamber of the rifle.
Figure 6:
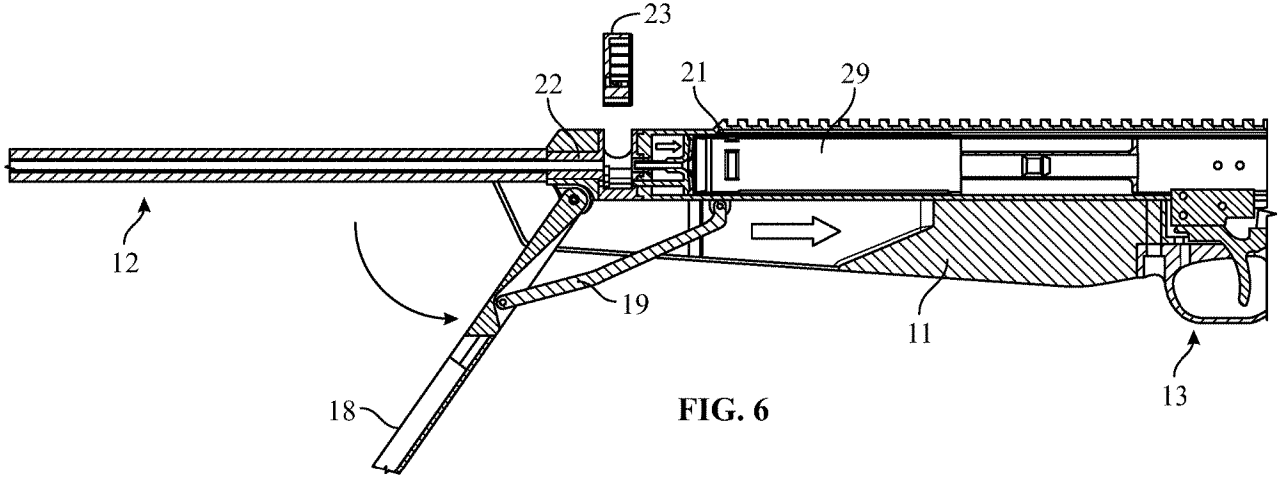
FIG. 6 is a sectional view showing the cocking lever moved to position to insert a magazine.
Figure 7:
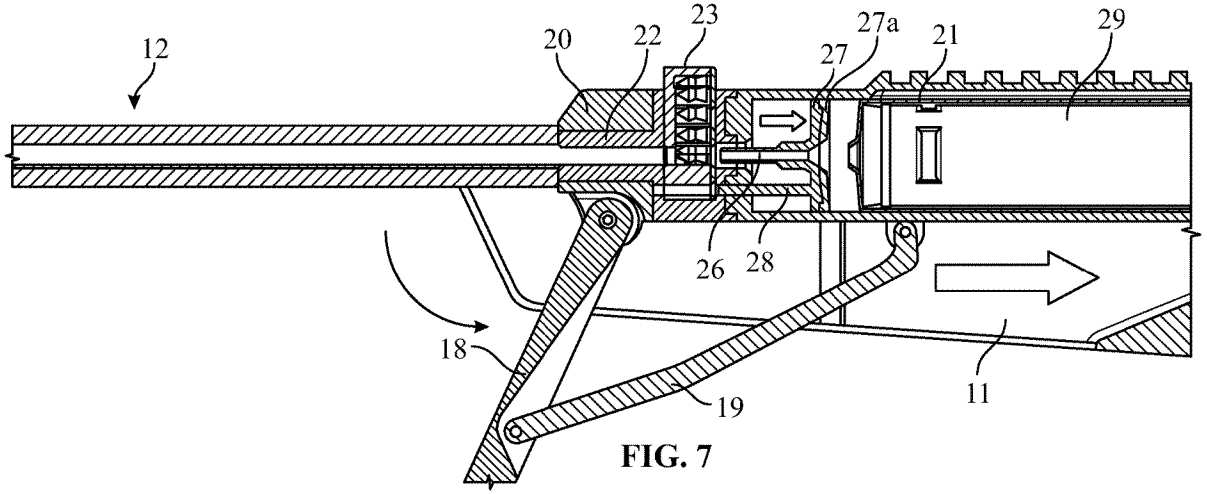
FIG. 7 is a sectional view showing the further movement of the cocking lever in the first embodiment.
Figure 8:
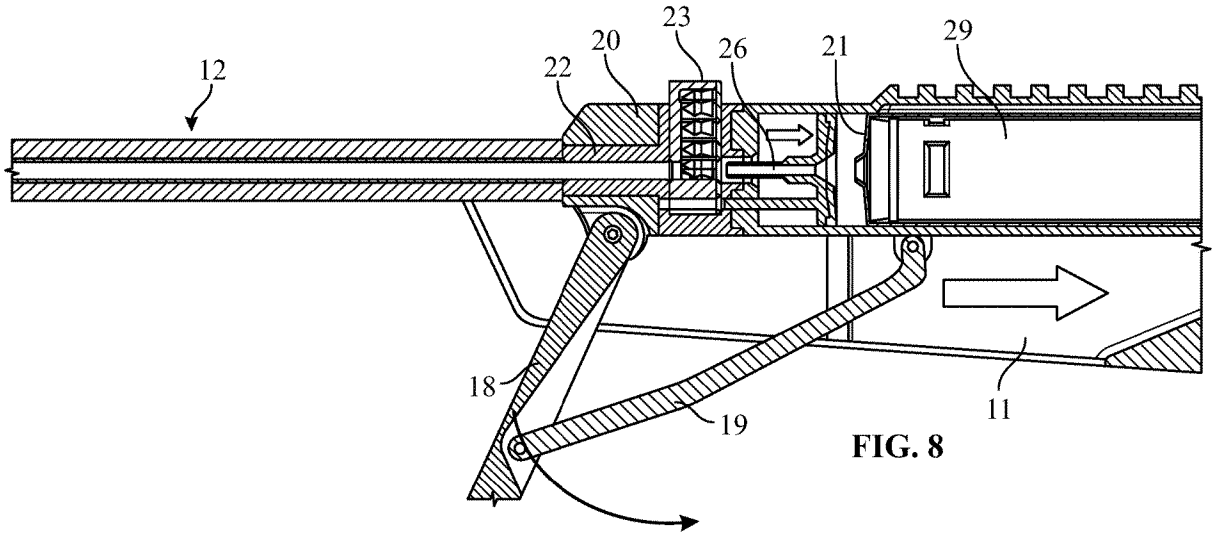
FIG. 8 is a sectional view showing movement of the cocking lever, cylinder and piston.
Figure 9:
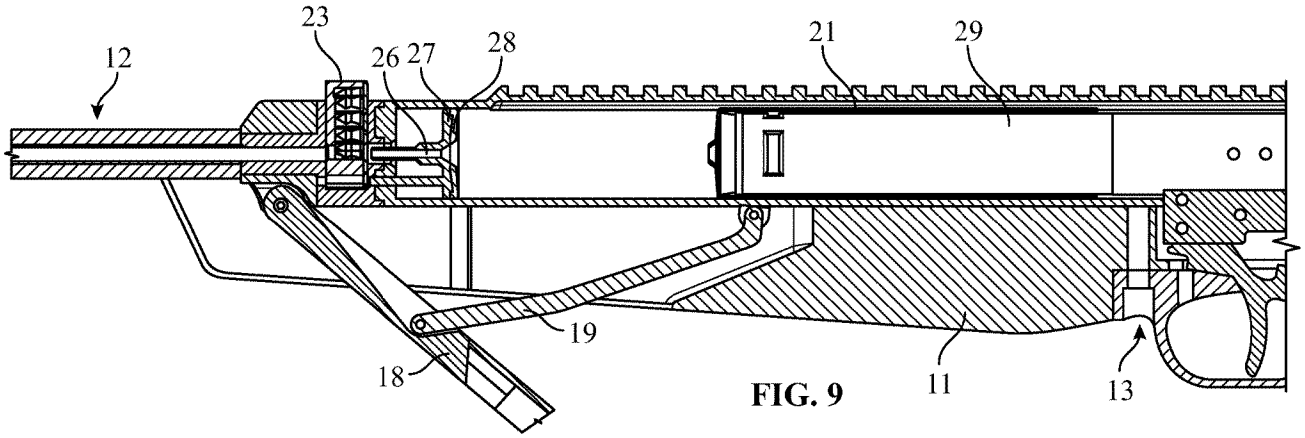
FIG. 9 is a sectional view showing movement of the cylinder and piston to a piston locking position.
Figure 10:
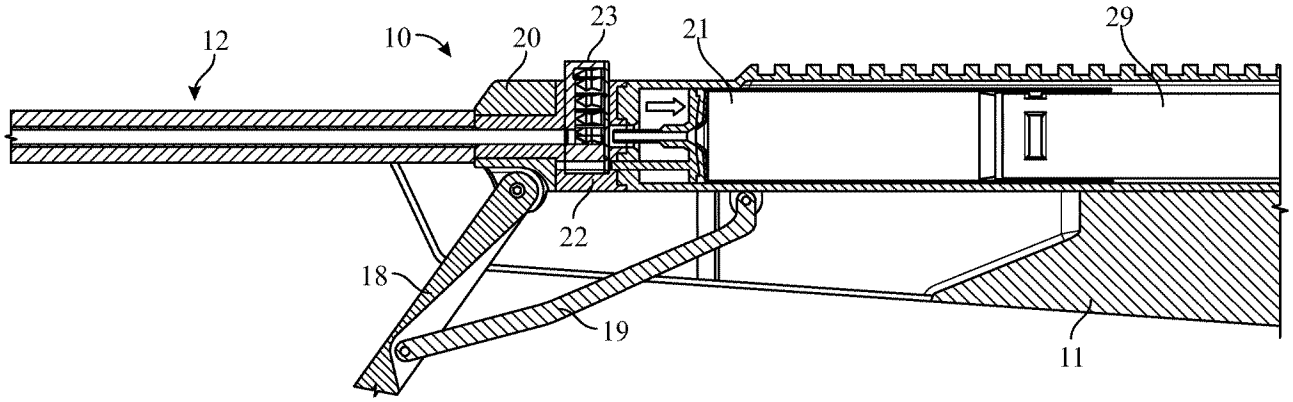
FIG. 10 is a sectional view showing the cylinder of the first embodiment returning to engage the feed nozzle.
Figure 11:
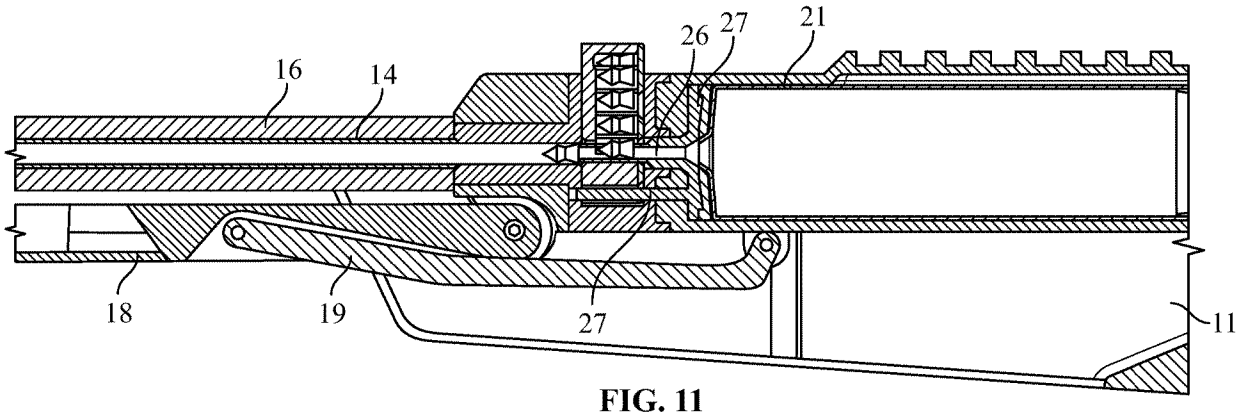
FIG. 11 is sectional view showing the cylinder and feed nozzle seated in the ready position with a projectile in the barrel.
Figure 12:
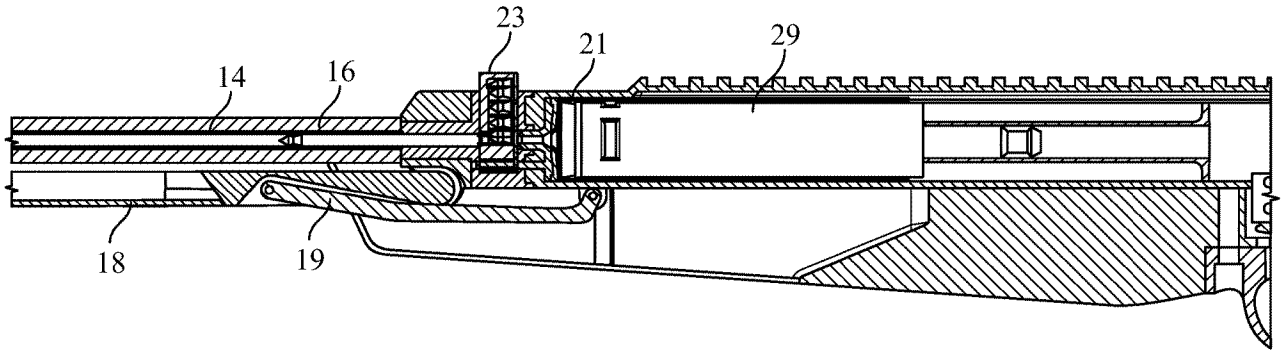
FIG. 12 is a sectional view showing the piston released to launch the projectile.

As seen in FIG. 5, a rearwardly biased pellet feed tube 26 and carrier 27 with an attached VDT (Trimethylsiloxy terminated vinylmethylsiloxane-dimethylsiloxane copolymer) gasket 27*a* is positioned such that an associated spring urges the feed tube 26 and an integral magazine locking pin 28 to a retracted position which allows for insertion, removal or rotation of the rotary magazine 23. Referring particularly to FIGS. 5 to 11, note that movable cylinder 21, formed of a composite, drawn steel, or other suitable material, is linked to cocking lever 18 such that movement of the cocking lever until an audible click is heard, moves the cylinder 21 rearwardly allowing the spring loaded pellet feed tube 26 and magazine locking pin 28 to move to the retracted position, which also allows the magazine 23 to advance by virtue of its internal spring and align a pellet with the barrel 12. The details of magazine 23 are discussed with reference to FIG. 13. Further movement of the cocking arm 18 moves the cylinder 21 and piston 29 to a full retracted position at which piston 29 compresses the conventional piston spring which may be a gas spring, metal spring or any other spring mechanism well known in the art, until the piston 29 is conventionally locked to the trigger assembly 13. Returning the cocking lever 18 to its storage position as shown in FIGS. 10 and 11 returns the cylinder 21 to its home position abutting the VDT gasket 27*a* which provides shock absorbing and sealing features, thereby urging the pellet feed tube 27 and magazine locking pin 29 into engagement with the magazine 23, such that a pellet in the magazine chamber aligned with the barrel is urged into a seated position in the barrel 12 by the hollow pellet feed tube 27.

Pulling the trigger mechanism 31 releases the piston 29 which explosively forces the air within the cylinder 21 through the pellet feed tube launching the pellet through the barrel and toward a target. Cycling the cocking lever far enough to release the magazine from the magazine locking arm allows removal of the magazine. If no magazine is being replaced in the assembly, returning the cocking lever to its home position seats the cylinder against the pellet feed tube without compressing the piston spring and arming the rifle so the rifle may be stored without dry firing.

Figure 13:
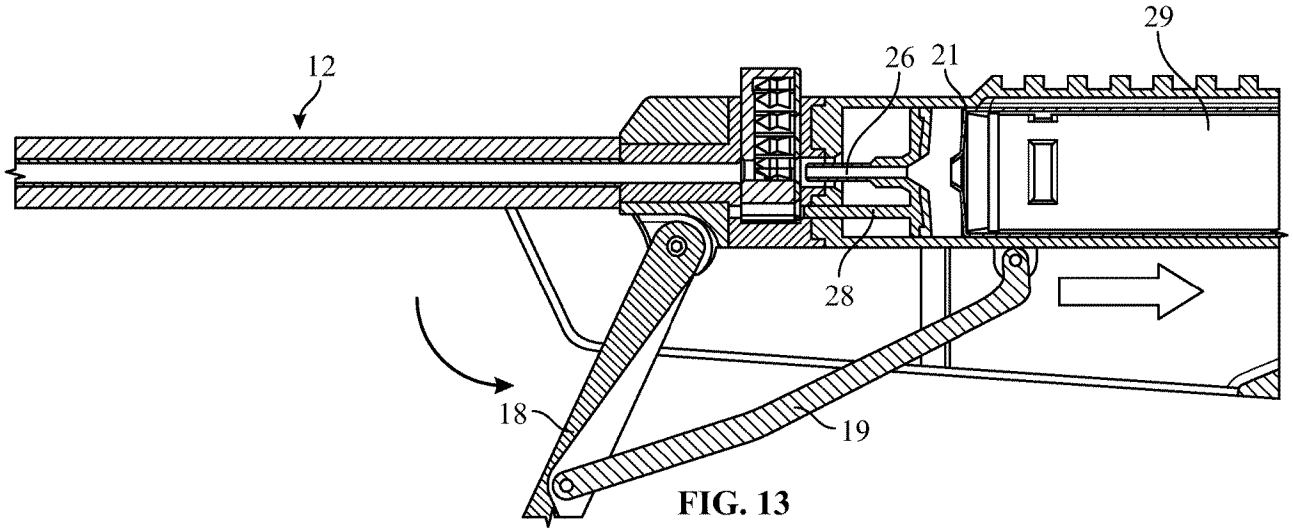
FIG. 13 is a sectional view depicting rotation of the rotary magazine.
Figure 14:
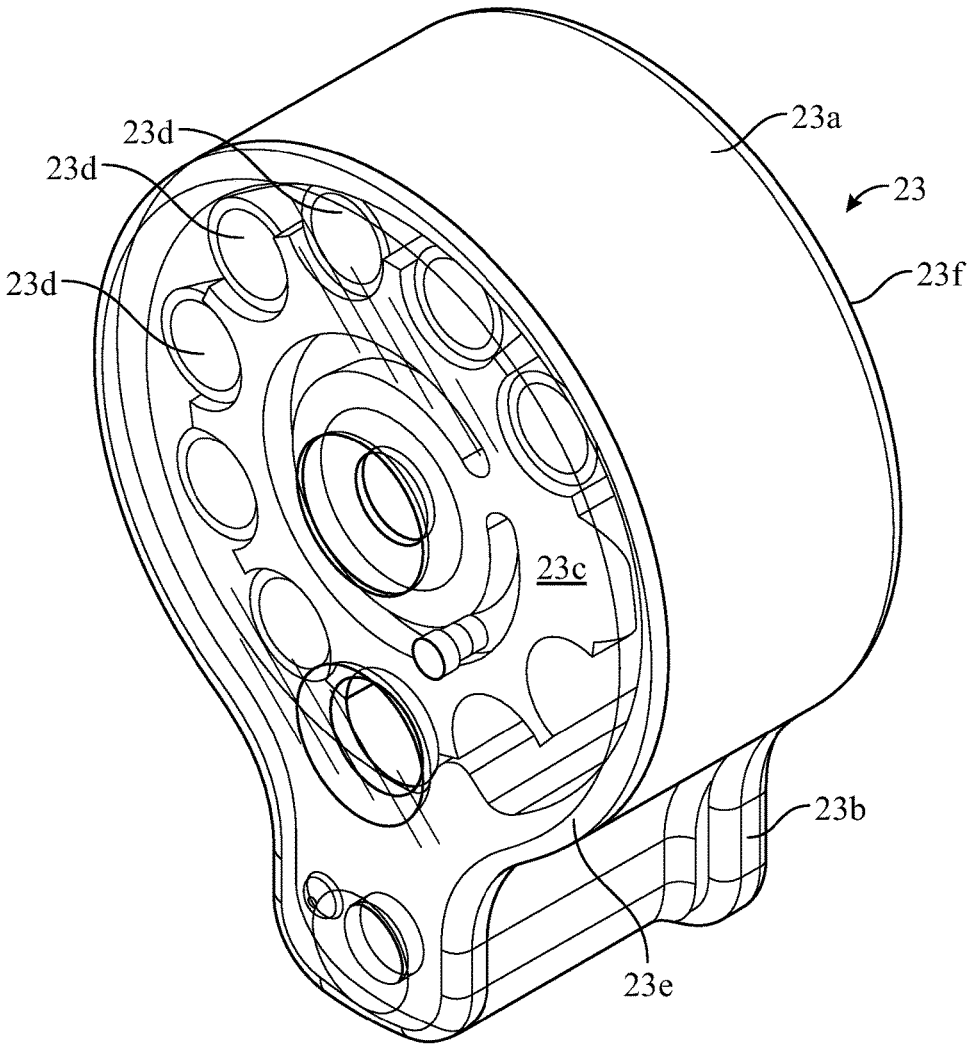
FIG. 14 is a detail view of the rotary magazine.

Referring to FIG. 13, it will be seen that rotary magazine 23 is generally tear drop or pear shaped with a larger rounded end 23*a* and a smaller projecting end 23*b*. Within the larger rounded end is a spring loaded carrousel 23*c* with a plurality of pellet chambers 23*d* formed in the carrousel. A front and rear panel 23*e* and *f* close the ends of the pellet chambers 23*d* except in one position which is aligned with the barrel 12 when the magazine 23 is inserted into the adapter. This position is also aligned with the pellet feed tube 26 which is moved into the chamber at that position forcing the pellet out of the magazine and into the barrel. Pellet feed tube 26 thus seals with the barrel 12 such that activation of the trigger mechanism delivers an expulsive volume of compressed air to the backside of the pellet in the barrel 12 launching the pellet toward the target.

It will be appreciated that magazine carrousel 23*c* cannot rotate to deliver a new pellet to the barrel as long as Pellet feed tube 26 remains within a chamber 23*d*. Further, in the embodiment shown in the preceding figures, magazine locking pin 27 is also engaged through an aperture in the magazine in the lower projecting end 23*b*. Thus the magazine spring only advances the carrousel 23*c* when the feed tube is withdrawn during the cocking action.

Figure 15:
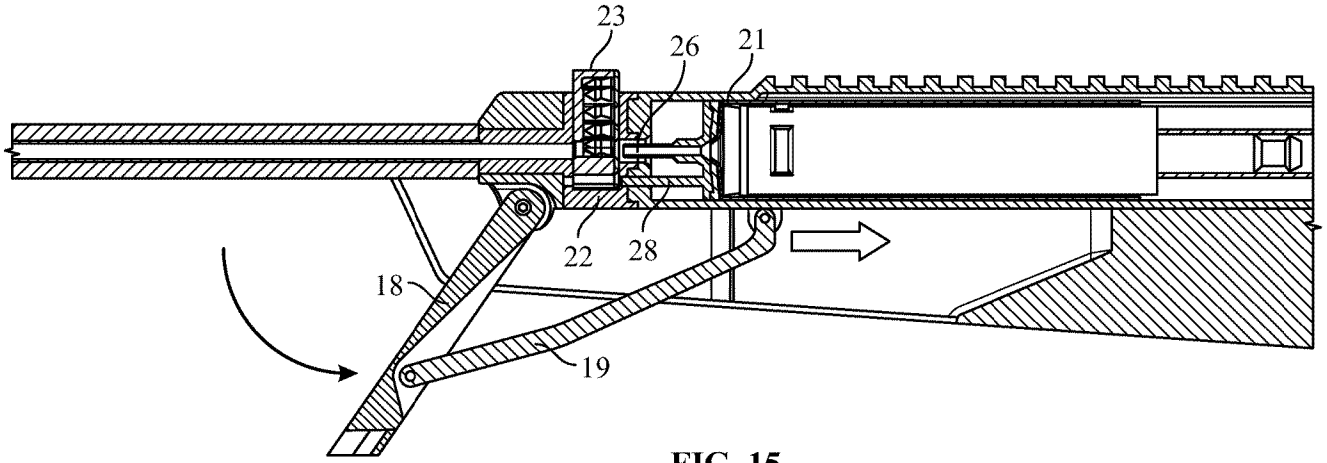
FIG. 15 is a sectional view of the rifle showing the feed nozzle retracted to allow removal of the magazine.
Figure 16:
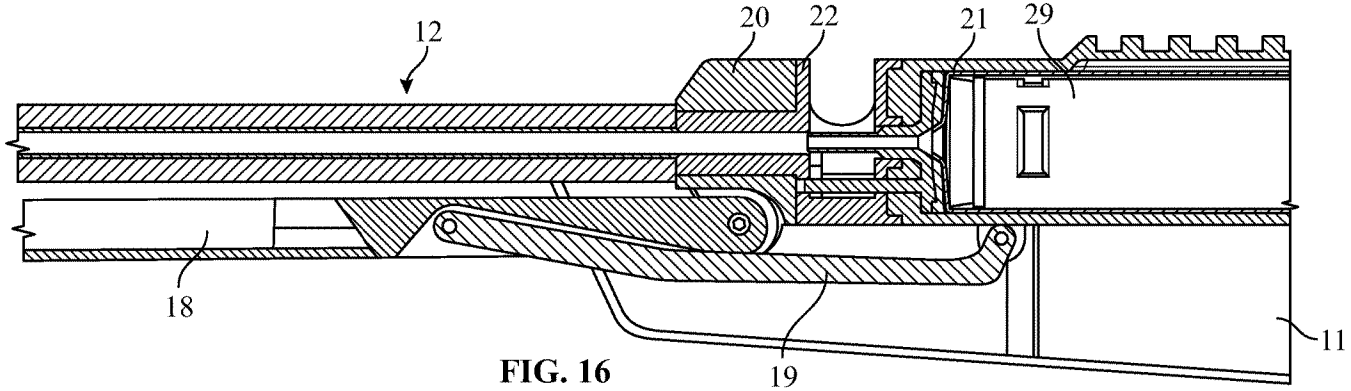
FIG. 16 is a sectional view showing the rifle with the magazine removed and ready for storage.

It should be noted that movement of the lever 19 to an intermediate position as shown in FIG. 15 brings the cylinder to a magazine open position such that the feed tube has moved out of engagement with the magazine 23 such that the magazine can only be withdrawn from the adapter 22 and fresh magazine inserted. Or the lever can be returned to its stored position with detent 12 engaged so that the rifle can be stored without a magazine in the adaptor. Note that the piston 29 is not moved rearwardly sufficiently to engage the trigger assembly 13, thus there is no need to discharge the stored energy of the spring before storage. It should also be noted that the magazine may take other forms, such as a spring loaded linear magazine.

Figure 17:
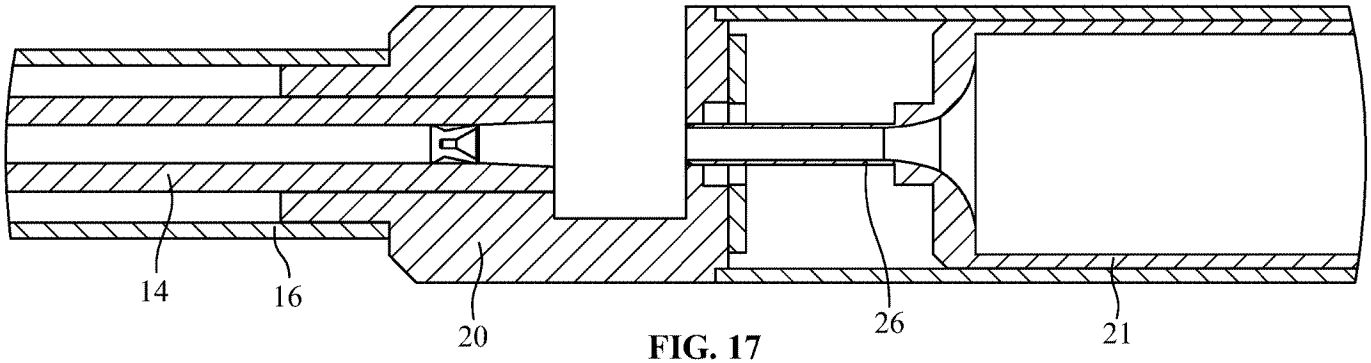
FIG. 17 is a partial section elevation view of a second embodiment of the cylinder and feed nozzle retracted to an open magazine position; and, FIG. 18 is partial section view of the second embodiment showing the unitary cylinder and feed nozzle in the forward position aligned with the barrel.
Figure 18:
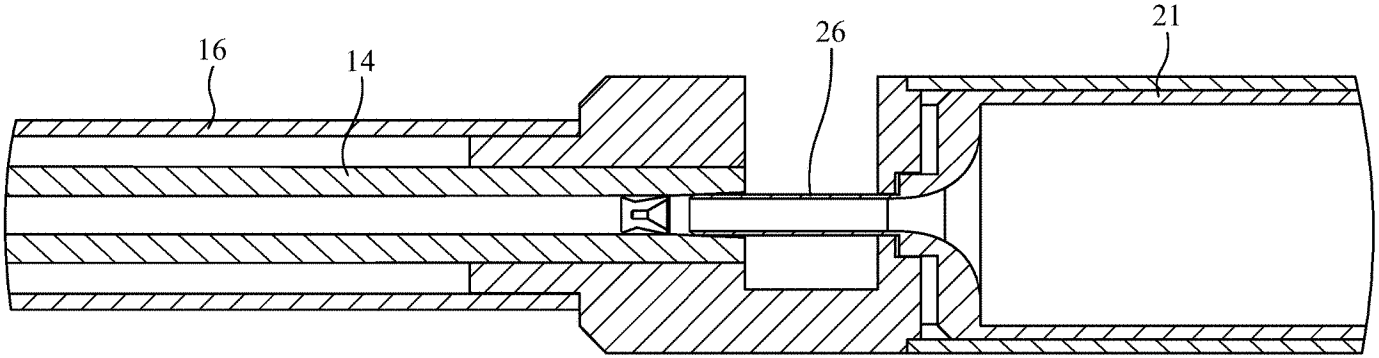

Referring to FIGS. 17 and 18, in a second embodiment the pellet feed tube 26 is formed directly on the end of cylinder 21 and a sealing and damping VDT gasket 21*a* is affixed to the body 20 about the orifice through which the feed tube passes. It will be understood that the magazine 23 is not shown in these drawings for clarity. It should also be noted that barrel 12 is shown in a shrouded configuration meaning that the inner metal barrel 12 has an annular space between it and the outer shroud mold 16*a*. It should be appreciated that aligning the barrel with the magazine chamber and the pellet feed tube not only provides for direct communication of the compressed air through the system thus improving the efficiency of the air gun, but also provides the opportunity to sheath the barrel in a manner that allows better alignment of the sights on the gun. In this embodiment the operation is somewhat simpler in that the feed tube 16 moves directly with the cylinder 21 and no intermediate carrier or guide is needed. Cocking of the lever 19 moves the cylinder 21 rearwardly and in so doing moves the hammer piston 29 rearwardly to engage the trigger assembly 13. Returning the lever 19 to its stored position returns the cylinder 21 to its forward position urging the pellet feed tube through the aligned chamber in the magazine 23, thereby moving the next pellet into firing position in the barrel. Thus, the operation of the underlever rifle is unchanged. It will be noted that either cylinder configuration can be used with a break barrel cocking mechanism or a pump action cocking mechanism without modification of the interaction between the cylinder and the magazine.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What I claim is:

1. A cocking and loading apparatus for an air gun having a barrel and trigger mechanism, comprising:

a movable cylinder defining an internal compression chamber and slidably mounted within a cylinder housing connecting said barrel and said trigger mechanism, said cylinder selectively movable between a forward and rearward position within said cylinder housing;

a spring loaded piston mounted within said cylinder and movable between a compressed position wherein the piston is retained by said trigger mechanism against a spring biasing force and a released position within said compression chamber and detached from said trigger mechanism;

a magazine adaptor in said cylinder housing between said barrel and said cylinder, the magazine adaptor including a forward tube aligned with and adjacent to said barrel, a rear tube aligned with said forward tube, and a body portion intermediate the forward tube and the rear tube, the body portion defining a space in which a magazine is removably received;

a pellet feed tube aligned with said rear tube, said forward tube, and said barrel, the pellet feed tube movable between a retracted position external of said magazine and a ready position wherein said pellet feed tube extends through said rear tube, said magazine, and into said forward tube, said pellet feed tube providing fluid communication between said barrel and said compression chamber.

2. The cocking and loading apparatus of claim 1 further comprising a movable lever connected to said cylinder such that movement of said lever between a stored position and a cocking position causes said cylinder to move from said forward position to said rearward position.

3. The cocking and loading apparatus of claim 1 wherein said cylinder receives said piston within said internal compression chamber and urges said piston into engagement with said trigger mechanism.

4. The cocking and loading apparatus of claim 1 wherein said cylinder is made from steel.

5. The cocking and loading apparatus of claim 1 wherein said cylinder is made from a polymer.

6. A cocking and loading apparatus as defined in claim 1 wherein said pellet feed tube is integral with a carrier within said body and biased away from said barrel, said carrier and said pellet feed tube positioned between said magazine and said cylinder such that movement of said cylinder to a forward position in said body urges said carrier to position said pellet feed tube within said magazine.

7. A cocking and loading apparatus as defined in claim 6 wherein said carrier also has a magazine locking pin extending therefrom for locking said magazine in place.

8. A cocking and loading apparatus as defined in claim 6 wherein said carrier includes a damping gasket.

9. A cocking and loading apparatus as defined in claim 6 further comprising a movable lever, connected to said cylinder such that movement of said lever between a stored position and a cocking position causes said cylinder to move from said forward position to said rearward position.

10. A cocking and loading apparatus as defined in claim 9 wherein said cylinder receives said piston there within and urges said piston into engagement with said trigger mechanism.

11. A cocking and loading apparatus as defined in claim 10 wherein said spring loaded magazine comprises a carousel having a plurality of pellet receiving chambers, a front and rear cover closing the magazine with said carousel mounted therein, said front and rear covers each having an aperture there through, aligned with each other and with said pellet feed tube when said magazine is positioned in said ready position, whereby each of the plurality of pellet receiving chambers may rotate into alignment with said apertures.

12. The cocking and loading apparatus of claim 1 wherein said magazine comprises a carousel having a plurality of pellet receiving chambers, a front and rear cover closing the magazine with said carousel mounted therein, said front and rear covers each having an aperture there through, aligned with each other and with said pellet feed tube when said magazine is positioned in said ready position, whereby each of the plurality of pellet receiving chambers may rotate into alignment with said apertures.

13. A cocking and loading apparatus as defined in claim 12 wherein said magazine includes protruding portion having an aperture therein for receipt of a magazine locking pin mounted for movement in coordination with said pellet feed tube.

14. The cocking and loading apparatus of claim 1 wherein said pellet feed tube is integrally formed on said cylinder in direct alignment with said barrel.

15. The cocking and loading apparatus of claim 14 wherein said cylinder is made from stainless steel.

16. The cocking and loading apparatus of claim 14 wherein said magazine comprises a carousel having a plurality of pellet receiving chambers, a front and rear cover closing the magazine with said carousel mounted therein, said front and rear covers each having an aperture there through, aligned with each other and with said pellet feed tube and barrel when said magazine is positioned in said ready position, whereby each of the plurality of pellet receiving chambers may rotate into alignment with said barrel.

17. The cocking and loading apparatus of claim 1 wherein the relative lengths of said pellet feed tube and said compression chamber are such that retraction of said cylinder to an open magazine position, at which said pellet feed tube is disengaged from said magazine, does not move said piston to said compressed position, whereby said magazine can be removed from said magazine receiver without fully cocking the piston.

18. The cocking and loading apparatus of claim 17 wherein said pellet feed tube is integrally formed on said cylinder in direct alignment with said barrel.

19. The cocking and loading apparatus of claim 17 further comprising a movable lever connected to said cylinder such that selective movement of said lever between a stored position, a lever position and a cocking position causes said cylinder to move between said forward position, said open magazine position and said rearward position.

20. The cocking and loading apparatus of claim 19 wherein said magazine comprises a carousel having a plurality of pellet receiving chambers, a front and rear cover closing the magazine with said carousel mounted therein, said front and rear covers each having an aperture there through, aligned with each other and with said pellet feed tube and barrel when said magazine is positioned in said ready position, whereby each of the plurality of pellet receiving chambers may rotate into alignment with said barrel.

* * * * *